US005195245A

United States Patent [19]

Malone

[11] Patent Number: 5,195,245

[45] Date of Patent: Mar. 23, 1993

[54] SAFETY SCISSORS

[75] Inventor: Jason R. Malone, Matthews, N.C.

[73] Assignee: Hoechst Celanese Corporation, Somerville, N.J.

[21] Appl. No.: 967,919

[22] Filed: Oct. 28, 1992

Related U.S. Application Data

[63] Continuation of Ser. No. 790,849, Nov. 12, 1991, abandoned.

[51] Int. Cl.[5] ..... B26B 13/06; B26B 13/00

[52] U.S. Cl. ..... 30/195; 30/233.5

[58] Field of Search ..... 30/194, 195, 197, 131, 30/200, 233, 233.5

[56] References Cited

U.S. PATENT DOCUMENTS

| | | | |
|---|---|---|---|
| 332,030 | 12/1885 | Young . | |
| 628,722 | 7/1899 | McCarter . | |
| 1,994,865 | 3/1935 | Onion . | |
| 2,008,631 | 7/1935 | Udkovich | 30/195 |
| 3,831,277 | 8/1974 | Nagata | 30/195 |
| 3,842,501 | 10/1974 | Honma . | |
| 3,888,005 | 6/1975 | Bagwell . | |
| 3,996,664 | 12/1976 | Lee . | |
| 4,170,064 | 10/1979 | Senk . | |
| 4,660,285 | 4/1987 | Pracht . | |
| 4,769,913 | 9/1988 | Kuramochi . | |
| 4,949,460 | 8/1990 | Sterk . | |

FOREIGN PATENT DOCUMENTS

| | | | |
|---|---|---|---|
| 932476 | 9/1955 | Fed. Rep. of Germany | 30/195 |
| 3506386 | 8/1986 | Fed. Rep. of Germany | 30/195 |
| 699498 | 11/1953 | United Kingdom | 30/195 |

*Primary Examiner*—Frank T. Yost
*Assistant Examiner*—Paul M. Heyrana
*Attorney, Agent, or Firm*—Philip P. McCann

[57] ABSTRACT

Synthetic fiber safety cutting scissors comprising a pair of first and second elongated scissor blades, each having an inner side and an outer side and a plurality of cutting edges separated by a plurality of non-cutting protrusions, and a gripping means; and a means for pivotally securing said first and second scissor blades to each other with said inner sides facing towards each other such that the said cutting edges cooperate with each other to cut strands of synthetic fiber. It has been found that with the protrusions that foreign objects such as fingers may be prevented from being intersected at the cutting edge.

6 Claims, 2 Drawing Sheets

SAFETY SCISSORS

This is a continuation of application Ser. No. 07/790,849 filed Nov. 12, 1991, abandoned.

BACKGROUND OF THE INVENTION

The invention relates to safety scissors used to cut synthetic fibers. In particular, the invention is directed to scissors having non-cutting protrusions separating cutting edges, whereby the protrusions are spaced to prevent foreign objects such as fingers from coming into contact with the nip of the cutting edges.

Various types of scissors are well known in the art. With the conventional scissors, the one scissor blade, when the scissors are closed, overlaps the cutting edge of the other scissor blade with its cutting edge throughout a portion of the length thereof so that between the cutting edges and the base of the cutting edge gap there is a nip which cuts the material. Most of such scissors are used to cut hair or cut other articles including synthetic fibers. However, as well known to one who has used scissors, foreign objects such as fingers can come between the cutting edges of the scissors, resulting in injuries.

Numerous types of scissors include projections extending from the cutting edge but providing teeth-like gaps as shown in U.S. Pat. No. 4,170,064 and 4,660,285. Thinning scissors with two serrated cutting edges are already known and shown in German Patent Specification No. 932,476. In these at least one scissor blade has ground cutting edge at the bottom of each of the gashes. It is also known for scissors to have serrated cutting edge of the scissor blade made corrugated for use in hair trimming.

However, such scissors have sharp serrated edges and still can pose a safety problem. Furthermore, such scissors were not designed for use in cutting synthetic fibers such as nylon, polyester, etc. It is the objective of the present invention to provide a safety scissor such that foreign objects such as fingers are prevented from entering the cutting edge of the scissor blades.

SUMMARY OF THE INVENTION

The object of the invention is based to design safety scissors of the generic type eliminating a safety hazard for the user.

According to the invention, the scissors comprise a) a pair of first and second elongated scissor blades, each having an inner side, an outer side, a plurality of cutting edges on the inner side, plurality of non-cutting protrusions on each blade and gripping means on each blade; and the means for pivotally securing said first and second scissors blades to each other with said inner sides facing towards each other such that said cutting edges cooperate with each other to cut when said first and second scissors blades are pivotally moved towards each other from an open position to a closed position and said non-cutting protrusions overlap with clearance and said non-cutting protrusions overlap with clearance with each other so as said first and second scissors blades are pivotally moved towards each other from an open position to a closed position.

In an advantageous development of the invention, the protrusions of the first and second scissor blades are spaced to prevent foreign objects such as fingers to enter into the area of the cutting edges. Such an advantage is useful in cutting strands of synthetic fibers.

BRIEF DESCRIPTION OF THE DRAWINGS

An embodiment of the invention will now be described by way of example, and with reference to the drawing in which.

DETAILED DESCRIPTION OF THE PREFERRED EMBODIMENT

Figure 1:
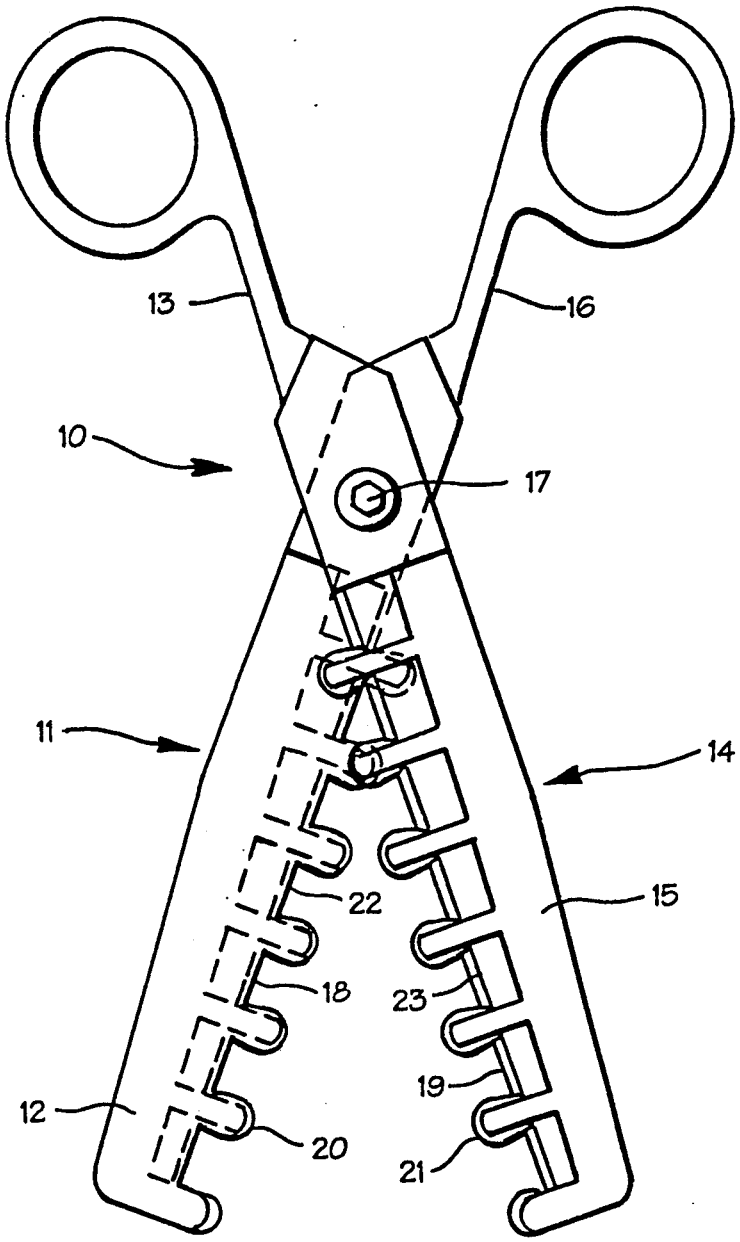
FIG. 1 is a front elevation view of closed cutting scissors according to the invention.
Figure 2:
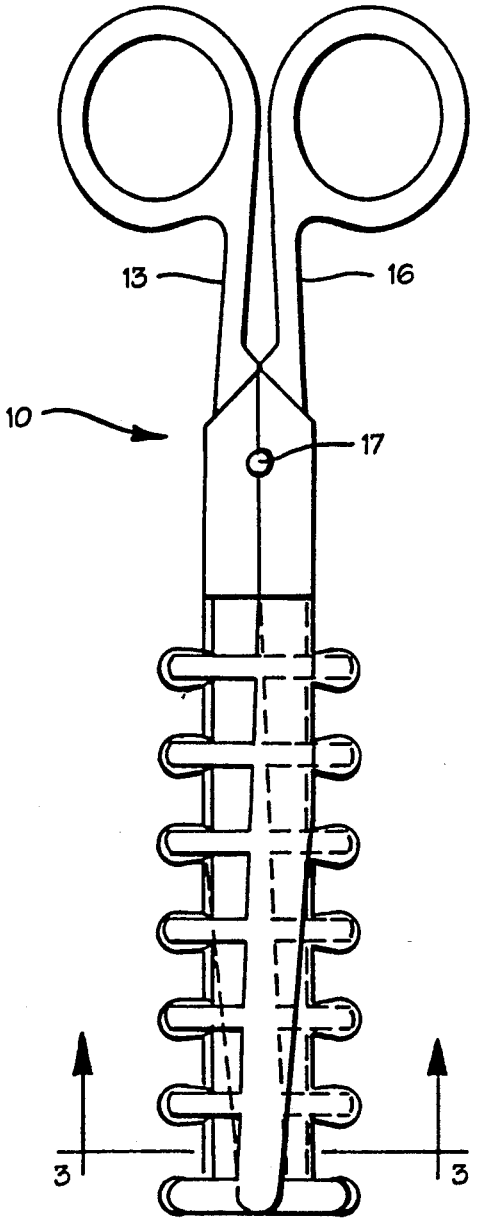
FIG. 2 is a rear elevational view of the opened scissors.
Figure 3:
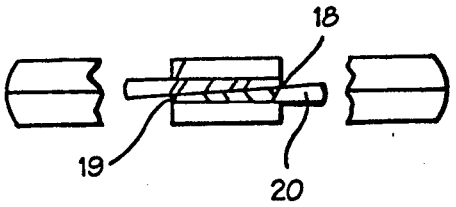
FIG. 3 is a sectional view of enlarged scale taken on the line 3—3 of FIG. 1.

In the following detailed description there is described a preferred embodiment of the invention. It will be recognized that although specific terms may be used in describing the preferred embodiment, these are used in the descriptive sense and are not generically and are used for the purposes of description and not of limitation. The invention is susceptible to numerous changes and variations within the spirit and the scope of the teachings herein as will be apparent to the skilled artist Now referring to the drawings illustrated in FIGS. 1 to 3 is a preferred embodiment of the scissors 10 of the present invention. The scissors 10 include a first scissor half 11 with a scissor blade 12 and a ring handle 13 and the reference numeral 14 denotes the other scissor half with a scissor blade 15 and a ring handle 16. The scissor halves 11 and 14 are connected to one another by means of a joint screw 17. The scissor blade 12 has a series of separated sharp cutting edges 18, and the scissor blade 15 has a series of separated sharp cutting edges 19. Furthermore, the scissor blade 12 has a series of non-cutting dull protrusions 20 and the scissor blade 15 has a series of non-cutting dull protrusions 21. As shown in FIGS. 1 and 2, the non-cutting dull protrusions 20 and 21 are shown as having an oval shape, thereby permitting the strands of fiber to pass over them easily.

Each smooth cutting edge 18, 19 as shown in FIG. 1 is a short linear smooth cutting edge located between a pair of adjacent non-cutting dull protrusions 20, 21. Furthermore, each smooth cutting edge 18, 19 is formed by an upper beveled edge 22, 23 that linearly intersects with the bottom flat side of each scissor blade 14, 15. Although these edges are shown as linear, other embodiments include bowed edges or slightly curved to facilitate cutting. Each non-cutting dull protrusion 20,21 as shown in FIGS. 1 and 2 extend outwardly from each smooth cutting edge 18, 19 forming a blunt projection. Also, each non-cutting dull protrusion 20, 21 is spaced from the back side of the opposite scissor blade 11, 14 to avoid a potential pinch point.

Individual scissor blades are aligned such that when they are pivoted amongst the screw 7 that the two cutting edges 18, 19 intersect to form a nip to cut the fiber. Furthermore, the two non-cutting dull edges 20 and 21 also intersect. In particular, said non-cutting protrusions overlap one above the other with clearance as said first and second scissors blades are pivotally moved towards each other from an open position to a closed position. The distance between each of non-cutting dull areas is spaced such as to prevent human fingers from coming in contact with the nip in between the two cutting edges. General length of separation of such dull areas is about $\frac{1}{8}$ inch.

It has been found that use of scissors can be used to cut synthetic polymers such as polyester and nylon. In particular, when a strand of such synthetic fibers is running, they are segregated into the cutting edges and cut without danger of cutting the personnel using the scissors. Such scissors may be made of normal materials including steel or part supplemented with plastic. The invention has been described with considerable detail with reference to its preferred embodiments. However, variations and modifications can be made within the spirit and scope of the invention as described in the foregoing specification and defined in the appended claims.

What is claimed is:

1. Scissors comprising (a) a pair of first and second elongated scissors blades each having an inner side, an outer side, a plurality of cutting edges on the inner side, separated by a plurality of non-cutting protrusions on each blade having same lengths from the cutting edge, and gripping means on each blade; and b) means for pivotally securing said first and second scissor blades to each other with said inner sides facing towards each other such that said cutting edges cooperate with each other to cut when said first and second scissors blades are pivotally moved towards each other from an open position to a closed position and said non-cutting protrusions overlap one above the others with clearance as said first and second scissor blades are pivotally moved towards each other from an open position to a closed position.

2. Scissors according to claim 1 wherein said cutting edges of said first and second scissor blades are linear.

3. Scissors according to claim 1 wherein said non-cutting protrusions are distanced above ⅛" from each other.

4. Fiber cutting scissors adapted to cut selected strands of spun fiber comprising;

(a) a pair of first nd second elongated scissors blades each having an inner side, an outer side, a plurality of cutting edges separated by a plurality of non-cutting protrusions, and gripping means; and b) means for pivotally securing said first and second scissor blades to each other with said inner sides facing towards each other such that said cutting edges cooperate with each other to cut when said first and second scissors blades re pivotally moved towards each other from an open position to a closed position and said non-cutting protrusions overlap one above the others with clearance as said first and second scissor blades are pivotally moved towards each other from an open position to a closed position.

5. Fiber cutting scissors of claim 4 wherein said cutting edges of said first and second scissors blades are linear.

6. Fiber cutting scissors of claim 4 wherein said non-cutting protrusions are distanced about ⅛" from each other.

* * * * *